US008226161B2

(12) United States Patent
Fiore, Jr. et al.

(10) Patent No.: US 8,226,161 B2
(45) Date of Patent: Jul. 24, 2012

(54) FOLDABLE CHILD BOOSTER SEAT

(75) Inventors: Joseph F. Fiore, Jr., Lebanon, PA (US); Zhang Shao-Yue, Taipei (TW)

(73) Assignee: Wonderland Nurserygoods Company Limited, Central (HK)

( * ) Notice: Subject to any disclaimer, the term of this patent is extended or adjusted under 35 U.S.C. 154(b) by 89 days.

(21) Appl. No.: 12/730,766

(22) Filed: Mar. 24, 2010

(65) Prior Publication Data

US 2010/0244503 A1 Sep. 30, 2010

Related U.S. Application Data

(60) Provisional application No. 61/210,997, filed on Mar. 25, 2009.

(30) Foreign Application Priority Data

Jan. 8, 2010 (CN) ..... 2010 1 0000306

(51) Int. Cl.
*A47D 1/10* (2006.01)
*A47D 1/02* (2006.01)
*A47B 83/02* (2006.01)

(52) U.S. Cl. ..... 297/153; 297/148; 297/149; 297/154; 297/174 R; 297/250.1; 297/256.11

(58) Field of Classification Search ..... 297/250.1, 297/256.11, 256.15, 256.16, 148, 149, 150, 297/153, 174 R, 467, 487, 154
See application file for complete search history.

(56) References Cited

U.S. PATENT DOCUMENTS

| | | | | |
|---|---|---|---|---|
| 4,842,331 | A * | 6/1989 | Waples | 297/149 |
| 4,854,638 | A * | 8/1989 | Marcus et al. | 297/256.11 |
| 4,938,603 | A * | 7/1990 | Turner et al. | 297/153 X |
| 5,183,311 | A * | 2/1993 | Meeker et al. | 297/153 X |
| 5,474,355 | A * | 12/1995 | Lerner et al. | 297/256.11 X |
| 5,609,389 | A * | 3/1997 | Longoria et al. | 297/153 X |
| 6,033,019 | A * | 3/2000 | Hession-Kunz et al. | 297/250.1 |
| 6,773,064 | B2 | 8/2004 | Treen et al. | |
| 6,832,813 | B2 * | 12/2004 | Tomas et al. | 297/250.1 |
| 7,104,603 | B2 * | 9/2006 | Keegan et al. | 297/256.15 X |
| 7,201,445 | B1 * | 4/2007 | Dubiel et al. | 297/153 X |
| 7,328,941 | B2 * | 2/2008 | Asbach et al. | 297/153 |
| 7,387,337 | B2 * | 6/2008 | Keegan et al. | 297/256.11 X |
| 7,673,940 | B2 * | 3/2010 | Fritz et al. | 297/256.11 |
| 7,695,060 | B2 * | 4/2010 | Dubiel et al. | 297/148 |
| 7,871,125 | B2 * | 1/2011 | Asbach et al. | 297/256.11 |

FOREIGN PATENT DOCUMENTS

CN 101194793 6/2008

* cited by examiner

*Primary Examiner* — Rodney B White
(74) *Attorney, Agent, or Firm* — Merchant & Gould P.C.

(57) ABSTRACT

A foldable child booster seat includes a seat base, a backrest, a support unit, and a tray. The seat base includes a seat portion having a seating surface, and a pair of armrests respectively disposed at left and right sides of the seat base. The backrest is mounted foldably to the seat base. The support unit is movably coupled to the seat base to permit height adjustment of the seat portion relative to the support unit. The tray is removably mountable to a selected one of the seat base and the support unit to dispose the tray in a selected one of a state of use and a stowed state.

19 Claims, 16 Drawing Sheets

FOLDABLE CHILD BOOSTER SEAT

CROSS-REFERENCE TO RELATED APPLICATIONS

This application claims priority to U.S. provisional application No. 61/210,997, filed on Mar. 25, 2009, and Chinese application no. 2010100000306.9, filed on Jan. 8, 2010.

BACKGROUND OF THE INVENTION

1. Field of the Invention

The invention relates to a foldable child booster seat, and more particularly to a foldable child booster seat that includes a foldable backrest.

2. Description of the Related Art

U.S. Pat. No. 6,773,064 discloses a child booster seat with a backrest that may be pivoted and a tray that may be attached to the child booster seat. However, with the tray attached to the bottom of the child booster seat, adjustment of the height of the child booster seat is likely to be restricted.

SUMMARY OF THE INVENTION

One object of the present invention is to provide a foldable child booster seat with a tray that may be disposed on a pair of armrests or on a support unit when the foldable child booster seat is at a use position or a folded position, respectively.

Another object of the present invention is to provide a foldable child booster seat with a backrest with opposite ends that are firmly supported when the backrest is at a folded position.

Yet another object of the present invention is to provide a foldable child booster seat which can be placed at an upright position when the backrest is disposed at the folded position. This allows a user to conveniently pick up or carry the child booster seat by a handle.

Accordingly, a foldable child booster seat according to one aspect of the present invention comprises a seat base that includes a seat portion having a seating surface, and a pair of armrests respectively disposed at left and right sides of the seat base. The foldable child booster seat further includes a backrest mounted foldably to the seat base, and a support unit movably coupled to the seat base to permit height adjustment of the seat portion relative to the support unit. The foldable child booster seat also includes a tray removably mountable to a selected one of the seat base and the support unit to dispose the tray in a selected one of a state of use and a stowed state.

One of the armrests includes a rearward inner side formed with a vertically extending elongated guide channel, and a first positioning space and a second positioning space that are vertically spaced apart. The second positioning space is disposed above the first positioning space.

The backrest includes a pivot piece that is movable along the elongated guide channel between the first positioning space and the second positioning space. The pivot piece is pivotable in the second positioning space to permit pivoting of the backrest between folded and unfolded positions relative to the seat base.

One of the armrests further includes a forward inner side provided with a first engaging part. The backrest further has an upper side provided with a second engaging part for coupling removably with the first engaging part when the backrest is at the folded position.

The first positioning space and the second positioning space are respectively disposed at opposite ends of the elongated guide channel and are in spatial communication with the elongated guide channel. The pivot piece resiliently projects from a lower lateral side of the backrest and is biased toward the armrest that is formed with the elongated guide channel.

The backrest is further formed with a horizontally extending slide channel. The pivot piece extends into the slide channel. The backrest further includes a manually operable part for moving the pivot piece along the slide channel to disengage the pivot piece from one of the first positioning space and the second positioning space. The backrest also includes a pivot piece spring for biasing the pivot piece toward the armrest that is formed with the elongated guide channel.

Each of the first positioning space and the second positioning space has a depth that is deeper than a depth of the elongated guide channel. One of the first engaging part and the second engaging part is formed with a latch cavity. The other one of the first engaging part and the second engaging part includes a latch for removably engaging the latch cavity. The foldable child booster seat further comprises a latch spring for biasing the latch toward the latch cavity.

The armrest with the elongated guide channel is further formed with a space-defining wall bordering the second positioning space. The space-defining wall has a shoulder, and the pivot piece has an eccentric protrusion that abuts against the shoulder when the backrest is at the folded position.

The seat base is formed with a handle cavity. The foldable child booster seat further comprises a handle received in the handle cavity and movable between a received position and an extended position relative to the seat base.

The foldable child booster seat further comprises a releasable coupling mechanism provided on the seat base and the handle for releasably retaining the handle at one of the received position and the extended position. The seat base has a handle cavity wall that confines the handle cavity. The releasable coupling mechanism includes a coupling part provided on the handle. The releasable coupling mechanism also includes a first limit part provided on the handle cavity wall to couple releasably with the coupling part when the handle is at the extended position.

The handle cavity has an open end through which the handle is extendable. The releasable coupling mechanism further includes a second limit part provided on the handle cavity wall. The first limit part and the second limit part are respectively proximate to and distal from the open end of the handle cavity. The second limit part couples releasably with the coupling part when the handle is at the received position.

The seat base and the backrest are configured to permit placement of the foldable child booster seat on a support surface with the handle oriented upward when the backrest is at the folded position. The backrest includes a housing that has a rear surface. The housing is formed with a storage space that opens toward the rear surface. The backrest also includes a cover pivoted to the housing for covering and uncovering the storage space.

The seat base is formed with a locking hole. The backrest is formed with a locking protrusion that is removably engageable with the locking hole when the backrest is at the unfolded position. The first positioning space and the eccentric protrusion are configured to arrest rotation of the backrest relative to the seat base when the backrest is at the unfolded position.

The foldable child booster seat according to the present invention has several advantages. For example, when the backrest is disposed at the folded position, the top and bottom ends of the backrest are firmly supported to prevent undesired vibration or drooping of the backrest ends. Moreover, the housing and cover of the backrest provide an effective storage space.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
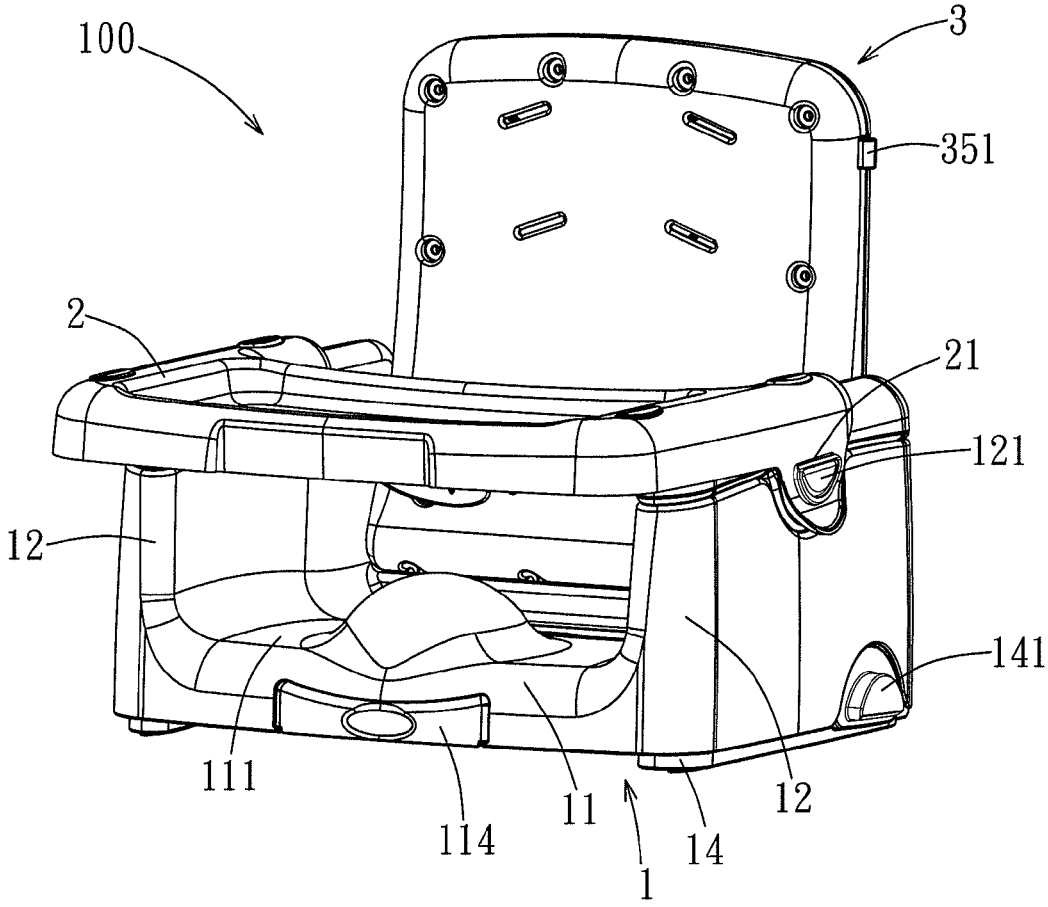
FIG. 1 is a perspective view of a foldable child booster seat according to the first preferred embodiment of the present invention.

The preferred embodiments of the present invention and their variations are presented in the following detailed description and the accompanying figures, in which like elements are denoted by the same reference numerals throughout the disclosure. It is noted that the figures are used solely for reference, and should not be construed to limit or restrict the claimed subject matter of the present invention.

Figure 2:
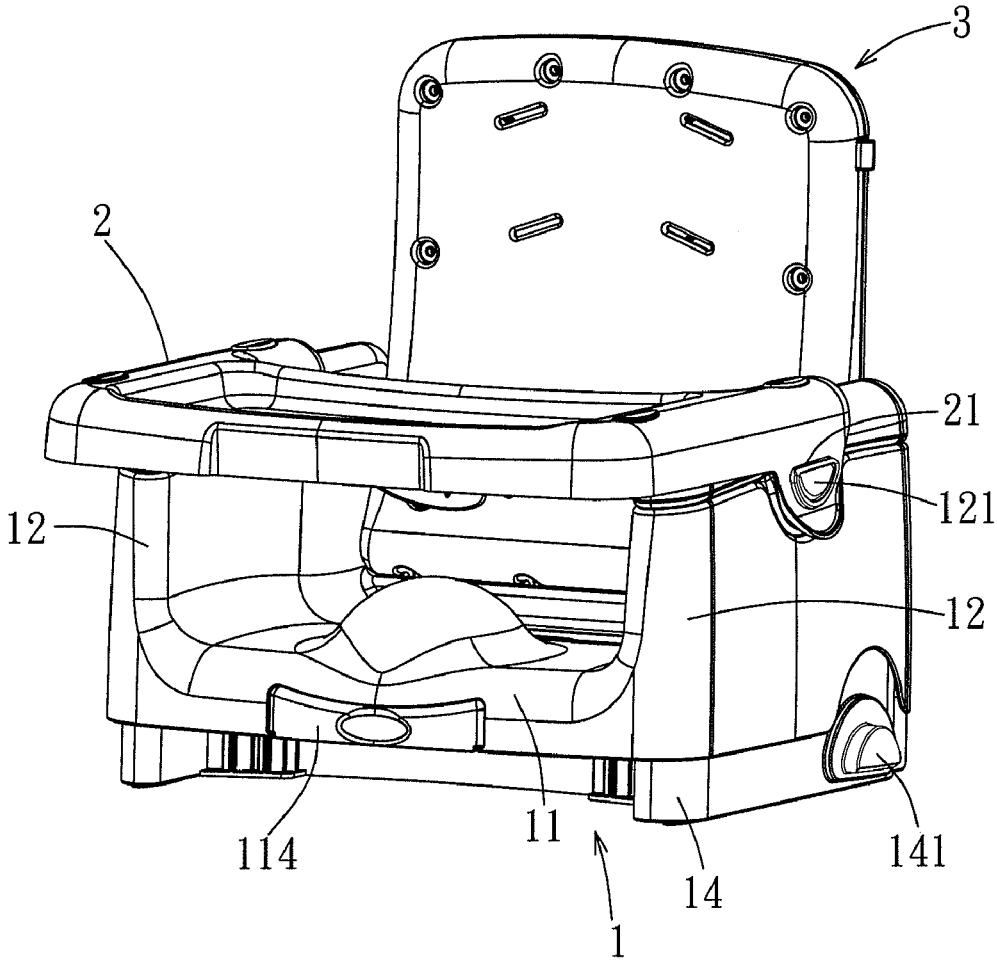
FIG. 2 is a perspective view of the foldable child booster seat at a raised position, according to the first preferred embodiment.
Figure 3:
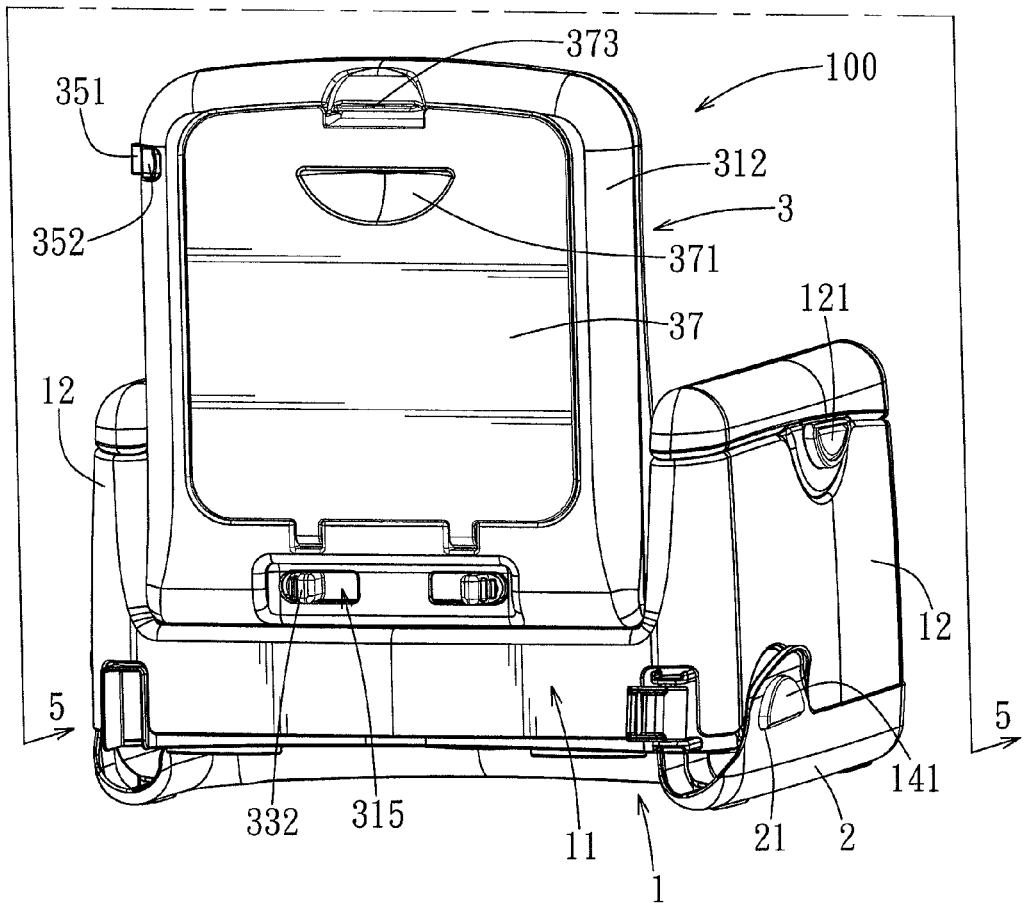
FIG. 3 is another perspective view of the foldable child booster seat with a tray mounted to a support unit, according to the first preferred embodiment.

As shown in FIGS. 1 to 3, the first preferred embodiment of a foldable child booster seat 100 according to the present invention comprises a seat base 1 that includes a pair of armrests 12 respectively disposed at left and right sides of the seat base 1, a backrest 3 mounted foldably to the seat base 1, a support unit 14 movably coupled to the seat base 1, and a tray 2 that is removably mountable to a selected one of the seat base 1 and the support unit 14 to dispose the tray 2 in either a state of use (see FIGS. 1 and 2) or a stowed state (see FIG. 3).

The seat base 1 includes a seat portion 11 with a seating surface 111 for a child to sit on. The support unit 14 extends into the seat portion 11 and is movable relative to the seat portion 11 for height adjustment of the seat portion 11 relative to the support unit 14.

Formed in the left and right lateral sides of the tray 2 are a pair of engaging holes 21. Each armrest 12 has an outer lateral side provided with an engaging block 121 adjacent to a top end thereof. In addition, each of the left and right sides of the support unit 14 is provided with an engaging block 141. When each engaging hole 21 of the tray 2 is engaged with a corresponding engaging block 121 of a corresponding armrest 12, the tray 2 is securely coupled to the seat base 1 so that it may support food or other objects.

On the other hand, when the tray 2 is not needed or when the foldable child booster seat 100 is to be switched from a state of use to a folded state, each of the two engaging holes 21 of the tray 2 may be disengaged from the corresponding engaging block 121 of the corresponding armrest 12. The tray 2 may then be inverted and disposed adjacent to a bottom of the support unit 14, allowing each engaging hole 21 of the tray 2 to be engaged with a corresponding engaging block 141 of the support unit 14.

Figure 10:
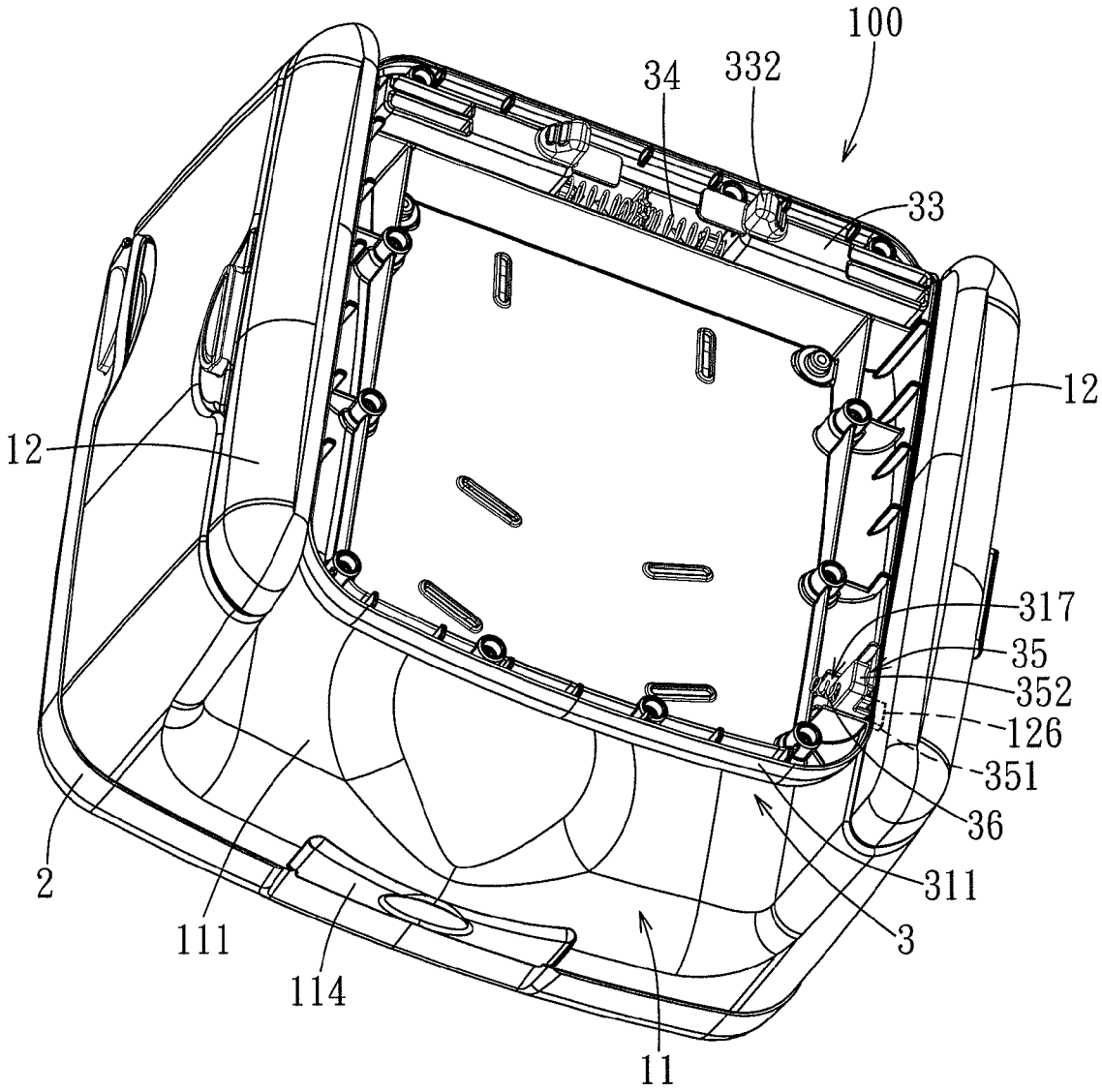
FIG. 10 is a perspective view showing the backrest at a folded position, according to the first preferred embodiment.

While the tray 2 is securely held to the support unit 14, the foldable child booster seat 100 may be used as a height-adjustable seat without a tray. In addition, with the tray 2 coupled to the support unit 14 of the seat base 1, the backrest 3 may be folded to switch the foldable child booster seat 100 from a state of use to a folded state (as shown in FIG. 10). In the description below, the tray 2 may be assumed to be disposed and held at the bottom of the support unit 14.

As shown in FIGS. 4 to 8, each armrest 12 has a rearward inner side formed with an elongated guide channel 123 extending along a vertical direction. A first positioning space 124 is disposed at the bottom end of each elongated guide channel 123, and is in spatial communication with the corresponding elongated guide channel 123.

The backrest 3 includes a housing 31 and a pair of pivot pieces 32. Each pivot piece 32 protrudes from a corresponding lateral side of the housing 31. Each pivot piece 32 may be extended into and engaged with either a corresponding first positioning space 124 or a corresponding second positioning space 125 (to be described in the succeeding paragraphs). A protruding rib 310 that is disposed at the bottom end of the housing 31 may be engaged with a channel 112 that is formed adjacent to a rear side of the seating surface 111 of the seat portion 11.

When each pivot piece 32 is engaged with the corresponding first positioning space 124 and the protruding rib 310 is engaged with the channel 112, the backrest 3 is held at an unfolded position. When the backrest 3 is at the unfolded position, the backrest 3 is substantially perpendicular to the seating surface 111 of the seat portion 11, and a child seated on the foldable child booster seat 100 may lean against the backrest 3.

The housing 31 includes a forward casing 311 and a rear frame 312 mounted to a back of the forward casing 311, such as with the use of screws. The forward casing 311 has a bottom part formed with a pair of horizontal slide channels 313 that are disposed side by side. Each horizontal slide channel 313 has an interior lateral end and an exterior lateral end disposed at either a respective left or right end of the corresponding horizontal slide channel 313. The exterior lateral end of each horizontal slide channel 313 is formed with a through hole 314 that is in spatial communication with the corresponding horizontal slide channel 313. Each through hole 314 may be aligned with a corresponding first positioning space 124 to permit a first end of a corresponding pivot piece 32 to be extended into the corresponding first positioning space 124.

The backrest 3 further includes a pair of manually operable parts 33, each mounted in a corresponding horizontal slide channel 313. Each manually operable part 33 includes amounting channel 331. A corresponding second end of each pivot piece 32 extends through a corresponding mounting channel 331 to engage a corresponding manually operable part 33.

Figure 5:
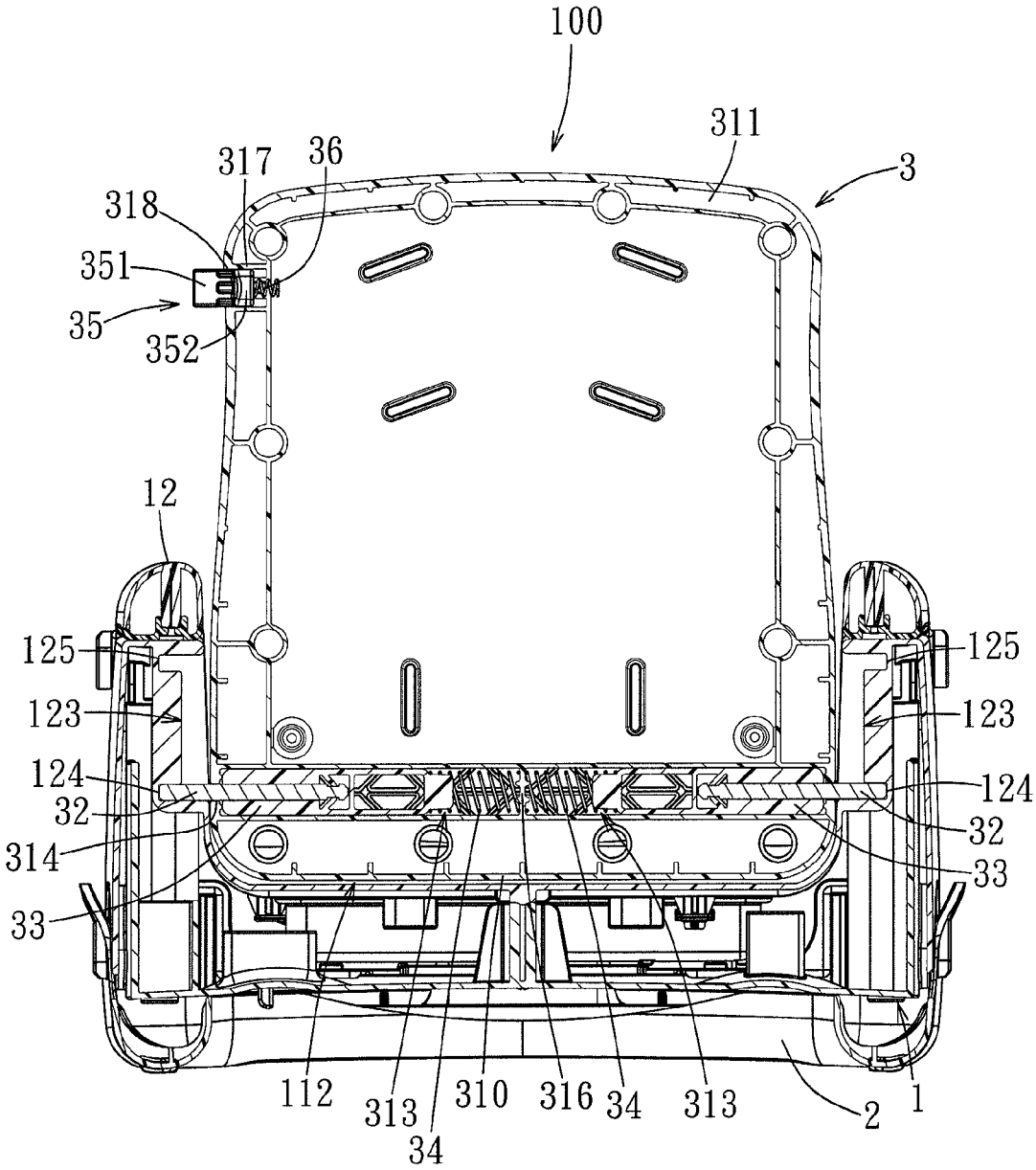
FIG. 5 is a schematic sectional view taken along line 5-5 in FIG. 3, illustrating the backrest and a seat base with a pair of pivot pieces that are each extended into a corresponding first positioning space, according to the first preferred embodiment.
Figure 6:
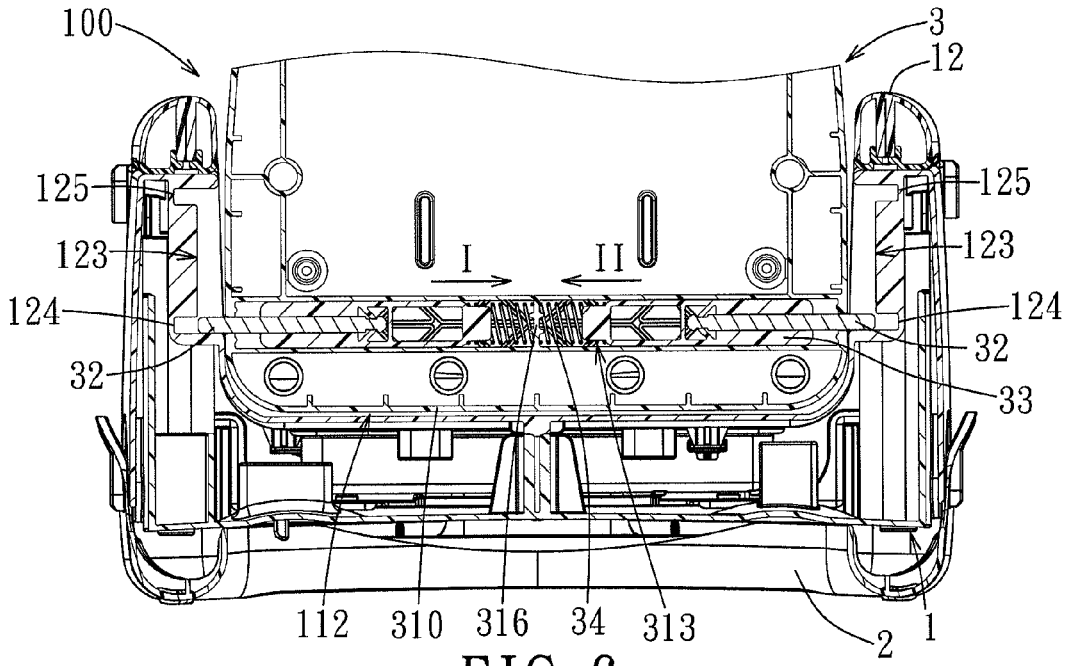
FIG. 6 is a fragmentary schematic sectional view of the backrest and the seat base with the pivot pieces that are each retracted from the corresponding first positioning space, according to the first preferred embodiment.

Each manually operable part 33 has a corresponding press part 332 that is accessible from a corresponding first opening 315 formed on the rear frame 312. A user can press each press portion 332 to slide the corresponding manually operable parts 33 either together or apart along the corresponding horizontal slide channel 313. This allows a user to move each pivot piece 32 that is connected to the corresponding manually operable part 33 between a respective holding position and a respective released position. When each pivot piece 32 is at the respective holding position and each through hole 314 is aligned with a corresponding first positioning space 124, each pivot piece 32 engages a corresponding first positioning space 124 (as shown in FIG. 5). When each pivot piece 32 is at the respective released position, the pivot pieces 32 are disengaged from the first positioning spaces 124 (as shown in FIG. 6).

The backrest 3 further includes a pair of pivot piece springs 34, each mounted in a corresponding slide channel 313. Each pivot piece spring 34 is a compression spring disposed between a partition plate 316 of the forward casing 311 and a corresponding manually operable part 33 for biasing a corresponding pivot piece 32 toward the inner lateral side of a corresponding armrest 12. Each pivot piece spring 34 provides the corresponding manually operable part 33 and the corresponding pivot piece 32 with a restoring force. Each pivot piece 32 thus projects resiliently from a corresponding lower lateral side of the backrest 3 and is biased toward the corresponding armrest 12.

The rearward inner side of each armrest 12 is further formed with a second positioning space 125 disposed at the top end of a corresponding elongated guide channel 123. The second positioning space 125 is disposed above and spaced apart from a corresponding first positioning space 124. The second positioning space 125 is disposed in spatial communication with the elongated guide channel 123.

The depths of the first positioning spaces 124 and the second positioning spaces 125 are deeper than the depths of the elongated guide channels 123. Each pivot piece 32 may thus be disposed at the respective released position while being moved between the corresponding first positioning space 124 and a corresponding second positioning space 125 along a corresponding elongated guide channel 123. Once each pivot pin 32 is aligned with the corresponding first positioning space 124 or the corresponding second positioning space 125, each pivot pin 32 is automatically further extended to engage the corresponding positioning space.

When each pivot piece 32 is extended and engaged with the corresponding second positioning space 125, the protruding rib 310 disposed at the bottom end of the backrest 3 is disengaged from the channel 112 of the seat portion 11. Each pivot piece 32 can then be pivoted about the corresponding second positioning space 125, thereby rotating the backrest 3 about the pivot pieces 32 between folded and unfolded positions relative to the seat base 1.

Moreover, a forward inner side of one of the armrests 12 is provided with a first engaging part 126, which is a latch cavity in this embodiment. The first engaging part 126 is disposed adjacent to a front end of the armrest 12 approximately at the height of the second positioning spaces 125.

The forward casing 311 of the backrest 3 includes a lateral side adjacent to a top end thereof that is formed with a guide slot 317 and a through opening 318 that are in spatial communication with each other. A second engaging part 35 is in sliding engagement with the guide slot 317. The second engaging part 35 has a latch 351 that extends through the through opening 318. The second engaging part 35 further includes an operating portion 352 accessible via a second opening 319 formed in the rear frame 312. The latch 351 removably engages the latch cavity to releasably lock the first engaging part 126 and the second engaging part 35 together.

When the backrest 3 is rotated to the folded position substantially parallel to the seating surface 111 of the seat portion 11 of the seat base 1 (as shown in FIG. 10), the latch 351 engages the first engaging part 126. Once releasably locked together, the latch 351 and the first engaging part 126 support a top end of the backrest 3 to prevent it from drooping downward while the backrest 3 is at the folded position. In order to release locking engagement between the second engagement part 35 and the first engaging part 126, the user can operate the operating portion 352 to slide the second engaging part 35 along the guide slot 317 and to disengage the latch 351 from the latch cavity. The foldable child booster seat 100 further comprises a latch spring 36 that biases the second engaging part 35 toward the inner lateral side of a corresponding armrest 12. In this embodiment, the latch spring 36 is a compression spring disposed in the guide slot 317.

As shown in FIG. 5, when each through hole 314 is aligned with the corresponding first positioning space 124, each pivot piece spring 34 biases the corresponding pivot piece 32 toward the corresponding first positioning space 124. Each pivot piece 32 is thus automatically engaged with the corresponding first positioning space 124. In addition, the protruding rib 310 at the bottom end of the housing 31 engages the channel 112 at the seat portion 11 to support the backrest 3 at the unfolded position.

As shown in FIGS. 3, and 6 to 8, to fold the backrest 3, a user can operate each press portion 332 of the corresponding manually operable parts 33 from the rear side of the backrest 3. The user can slide the two manually operable parts 33 along the horizontal slide channel 313 together (e.g., in the directions I and II), which compresses the corresponding pivot piece spring 34 and gradually disengages the corresponding pivot piece 32 from the corresponding first positioning space 124.

When each manually operable part 33 is disposed at a corresponding inner lateral end of the corresponding first opening 315, each pivot piece 32 is disposed at the corresponding released position and is completely disengaged from the corresponding first positioning space 124. At this time, the user can extend his/her fingers into a concave portion 371 of a cover 37 (to be described in the succeeding paragraphs) assembled on the rear frame 312 to lift the backrest 3 upward (e.g., in the direction III). The backrest 3 may be raised to slide each pivot piece 32 upward along the corresponding elongated guide channel 123 and to move the backrest 3 to the position illustrated in FIG. 9.

When each pivot piece 32 has been moved to the top end of the corresponding elongated guide channel 123, each pivot piece 32 may be aligned with the corresponding second positioning space 125. The user can then release each press portion 332 of a corresponding manually operable part 33 to allow the corresponding pivot piece spring 34 to move the corresponding pivot piece 32 outward and into the corresponding second positioning space 125. Each pivot piece spring 34 therefore engages the corresponding pivot piece 32 with the corresponding second positioning space 125 to dispose each pivot piece 32 at the respective holding state. The user can then fold the backrest 3 in the direction IV (see FIG. 9) by rotating the backrest 3 relative to the seat base 1 about the pivot pieces 32.

Figure 4:
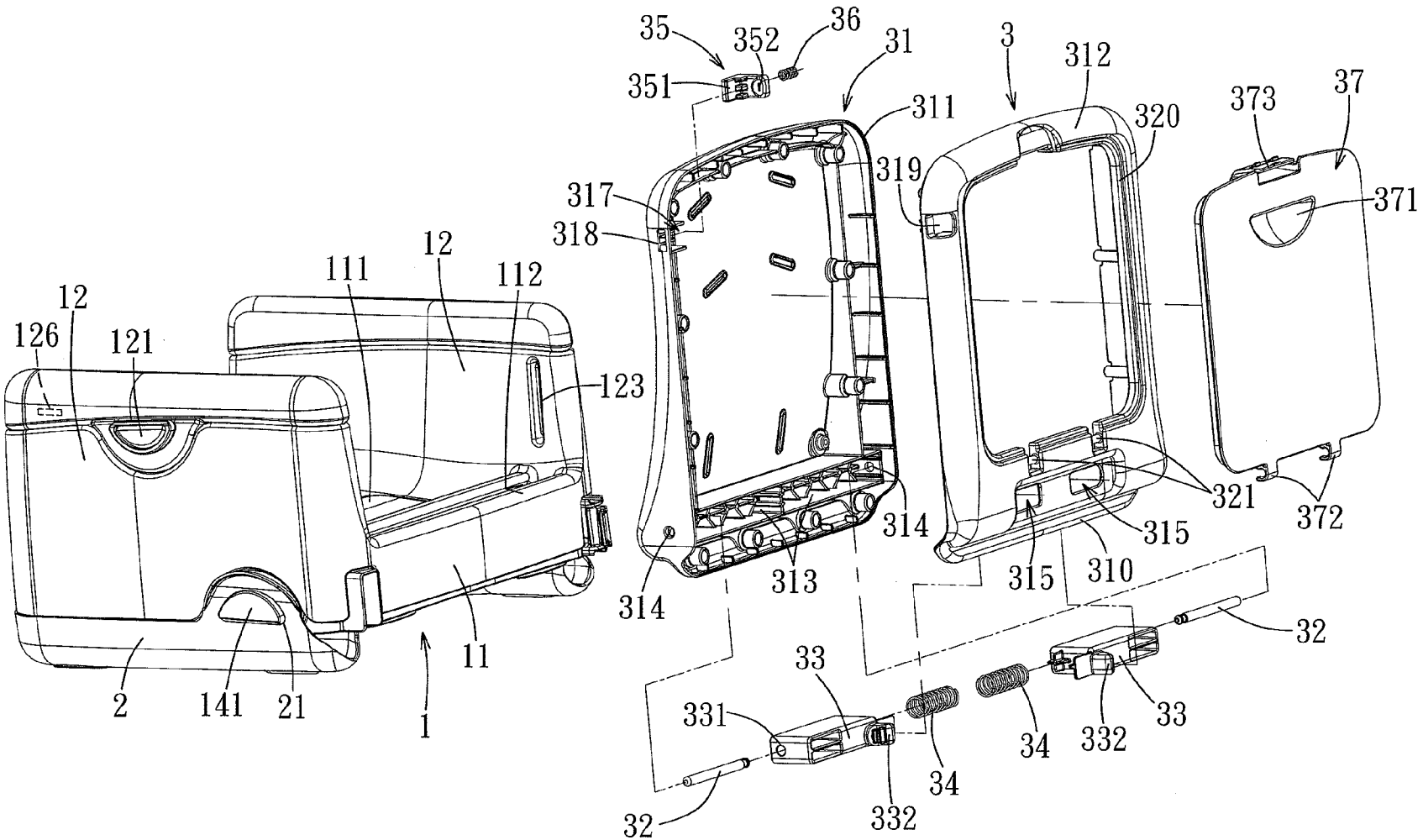
FIG. 4 is an exploded perspective view of a backrest of the foldable child booster seat, according to the first preferred embodiment.
Figure 8:
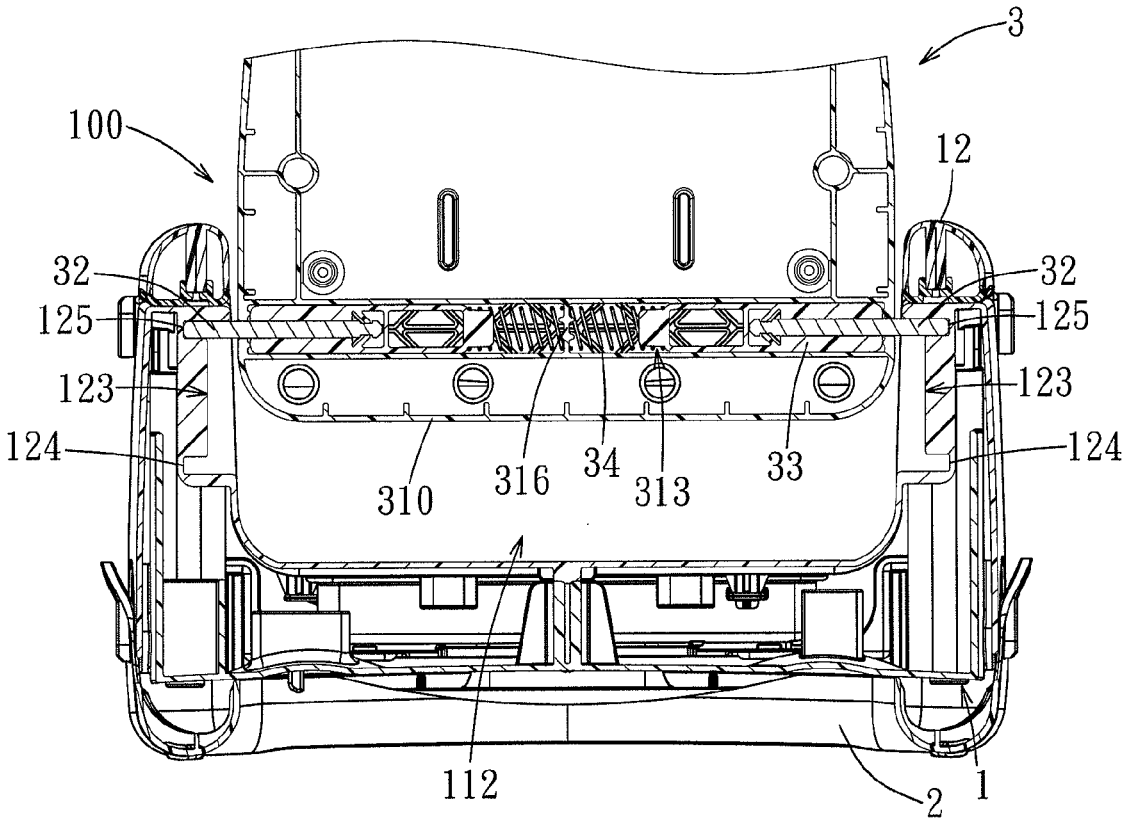
FIG. 8 is a fragmentary schematic sectional view of a backrest and seat base with a pair of pivot pieces that are each extended into the corresponding second positioning space, according to the first preferred embodiment.

As shown in FIGS. 4, 8 and 10, the backrest 3 may be rotated in the direction IV until the latch 351 of the second engaging part 35 contacts the corresponding armrest 12. The armrest 12 may press and retract the latch 351 into the guide slot 317, which also compresses the latch spring 36. The backrest 3 may continue to be rotated in the direction IV until the through hole 318 is aligned with the first engaging part 126. This permits the force of the latch spring 36 to move the latch 351 of the second engaging part 35 outward to engage the first engaging part 126. At the same time, each pivot piece 32 engages the corresponding second positioning space 125 as shown in FIG. 8. Accordingly, when the backrest 3 is at the folded position, the top and bottom ends of the backrest 3 are firmly supported to reduce vibration and to prevent either the top or bottom end of the backrest 3 from drooping downward.

Figure 9:
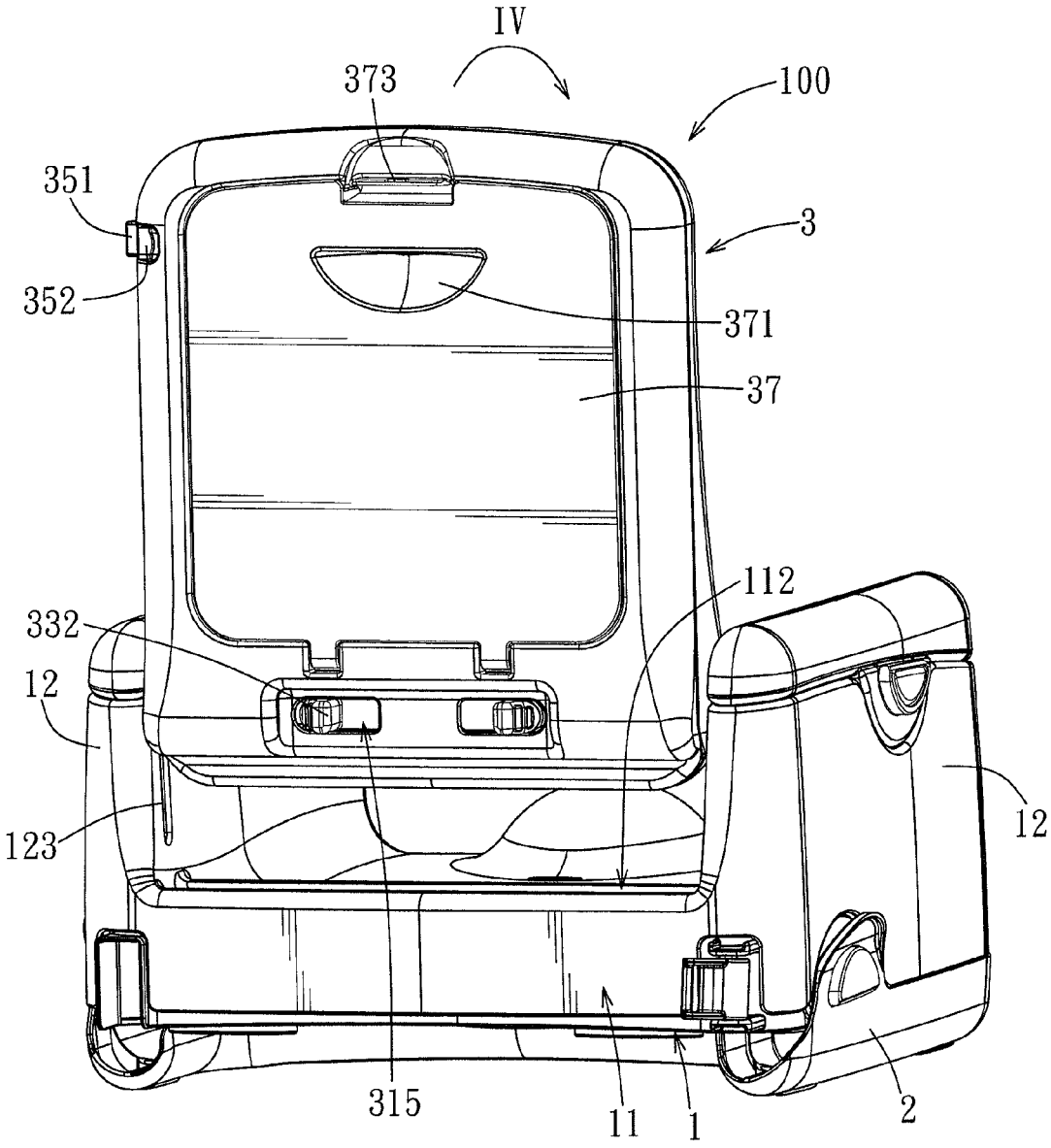
FIG. 9 is a perspective view showing the backrest at a raised position, according to the first preferred embodiment.

In order to move the backrest 3 from the folded position to the unfolded position, the user first operates the operating portion 352 of the second engaging part 35 to disengage the latch 351 and the first engaging part 126 from each other. The user can then rotate the backrest 3 in a direction opposite to the direction IV (as shown in FIG. 9) to reach the position shown in FIG. 9. Each of the two press portions 332 of the manually operable parts 33 may then be operated to slide the corresponding manually operable parts 33 together along the horizontal slide channels 313. This compresses each pivot piece spring 34 and disengages the corresponding pivot piece 32 from the corresponding second positioning space 125.

Figure 7:
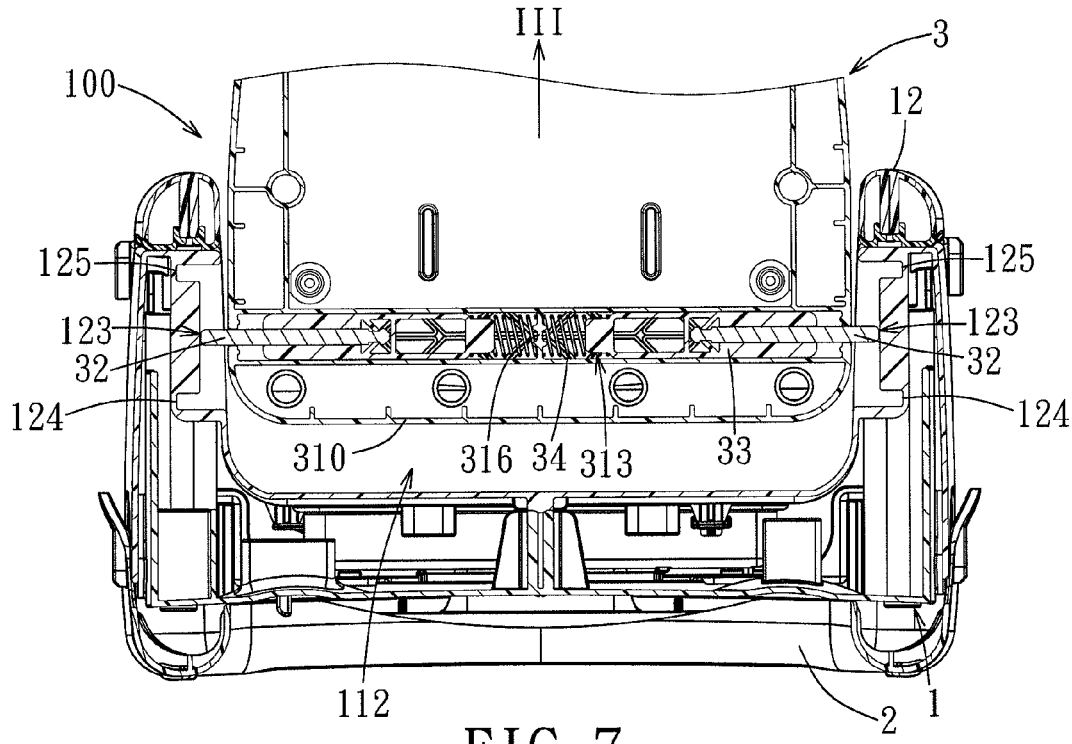
FIG. 7 is a fragmentary schematic sectional view of the backrest and the seat base with the pivot pieces that are each in the corresponding elongated guide groove between corresponding first and second positioning spaces, according to the first preferred embodiment.

In order to reach the position shown in FIG. 5, the backrest 3 may be moved in a direction opposite to the direction III (as shown in FIG. 7) to slide each pivot piece 32 until it is aligned with the corresponding first positioning space 124. The corresponding press portions 332 of each manually operable part 33 may then be released, permitting the force of each pivot piece spring 34 to move the corresponding pivot pieces 32 outward along the horizontal slide channels 313. This permits each pivot piece 32 to be extended into the corresponding first positioning space 124 to dispose each pivot piece 32 at the holding position. In addition, the protruding rib 310 at the bottom end of the housing 31 engages the channel 112 of the seat portion 11. In this way, the backrest 3 is restored to the unfolded position shown in FIG. 5.

Figure 11:
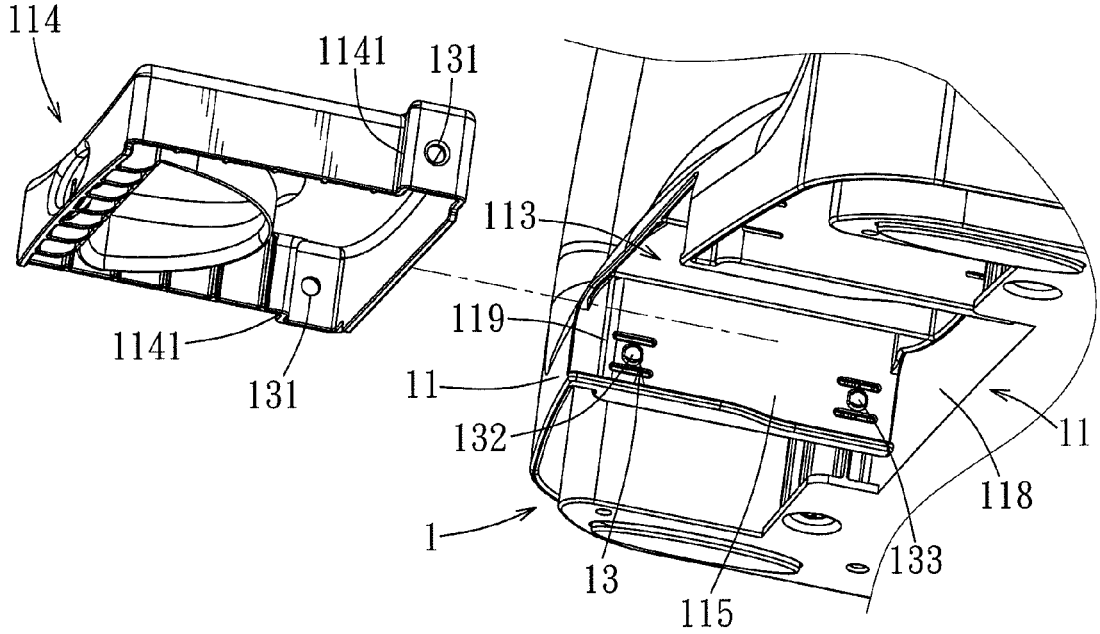
FIG. 11 is an enlarged fragmentary exploded perspective view of a releasable coupling mechanism, a handle, and a handle cavity, according to the first preferred embodiment.
Figure 12:
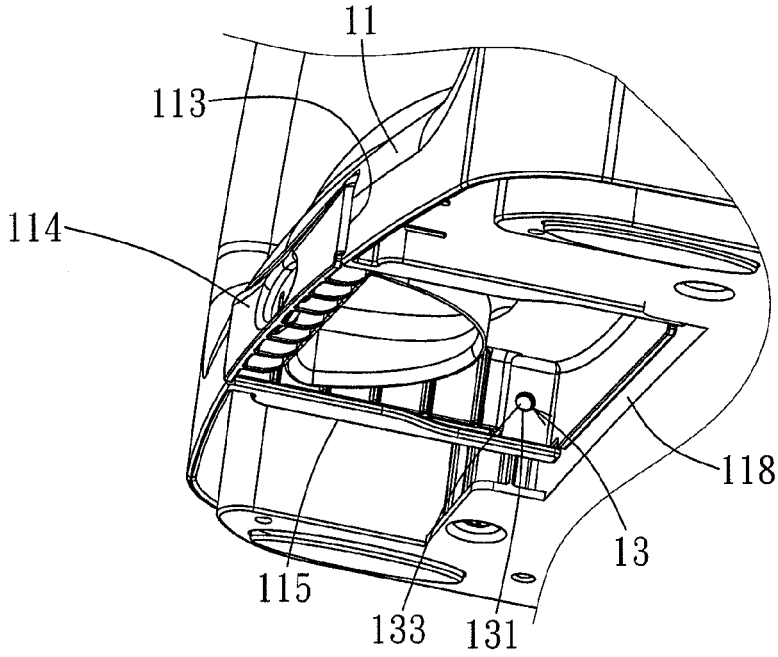
FIG. 12 is an enlarged fragmentary perspective view of the handle at a received position, according to the first preferred embodiment.
Figure 13:
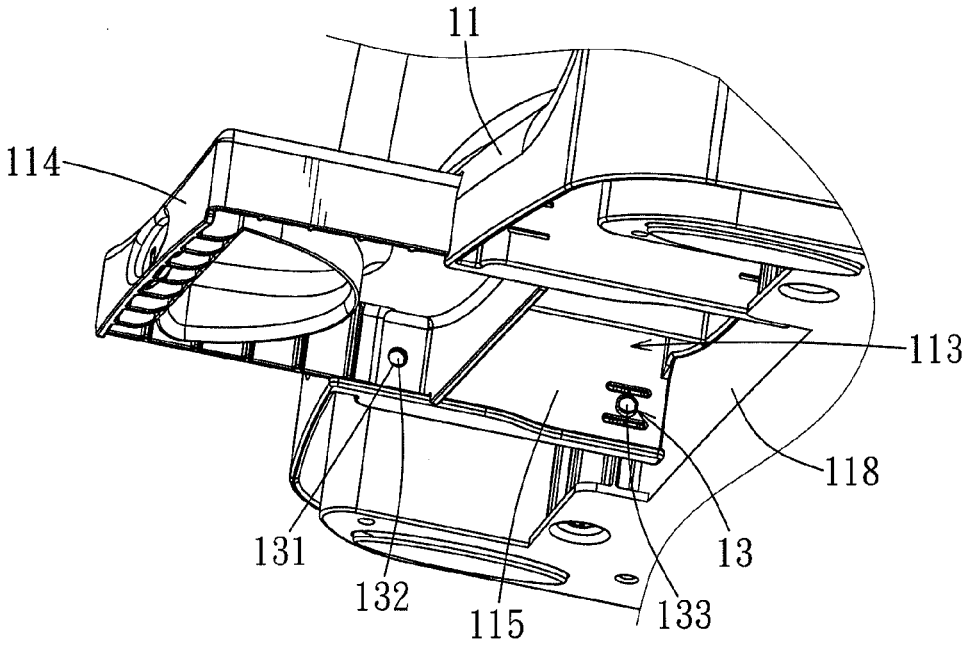
FIG. 13 is an enlarged fragmentary perspective view of the handle at an extended position, according to the first preferred embodiment.
Figure 14:
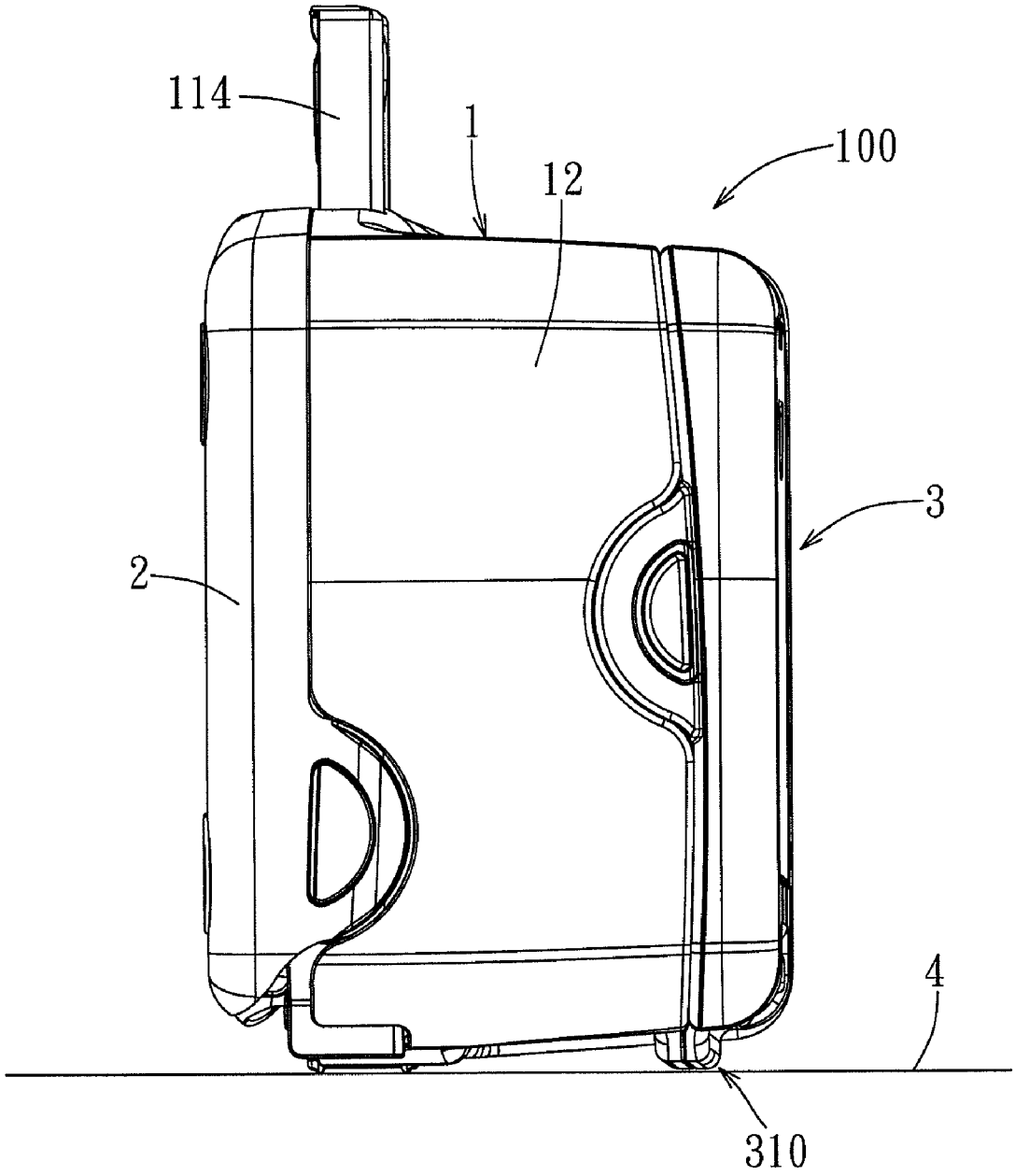
FIG. 14 is a perspective view of the foldable child booster seat placed on a support surface with the handle oriented upward, according to the first preferred embodiment.

As shown in FIGS. 11 to 13, the first preferred embodiment of the foldable child booster seat 100 of this invention further comprises a handle 114 to assist with carrying the foldable child booster seat 100 when the tray 2 has been stowed and the backrest 3 has been folded (as shown in FIG. 14). The seat portion 11 of the seat base 1 includes a bottom formed with a handle cavity 113. The seat base 1 has a handle cavity wall 115 that confines the handle cavity 113, which has an open end through which the handle 114 is extendable.

The handle 114 is received in the handle cavity 113 and is movable relative to the seat base 1 between a received position (as shown in FIG. 12) and an extended position (as shown in FIG. 13). Accordingly, when a user wishes to carry the foldable child booster seat 100 using the handle 114, the handle 114 may be pulled out from the received position to the extended position to facilitate carrying of the foldable child booster seat 100. The foldable child booster seat 100 further comprises a releasable coupling mechanism 13 provided on the handle 114 and the seat base 1 for releasably retaining the handle 114 at either the received position or the extended position.

The releasable coupling mechanism 13 includes a pair of coupling parts 131 provided on the handle 114, each disposed on a lateral side close to a rear end of the handle 114. The releasable coupling mechanism 13 further includes a pair of first limit parts 132 and a pair of second limit parts 133 provided on the handle cavity wall 115 (only one of the first limit parts 132 and one of the second limit parts 133 is visible in the figures). Each coupling part 131 is an engaging orifice, and each of the first limit parts 132 and the second limit parts 133 is an engaging block for engaging one of the engaging orifices 131.

Each first limit part 132 and a corresponding second limit part 133 are respectively proximate to and distal from the open end of the handle cavity 113. Each coupling part 131 releasably couples with either a corresponding first limit part 132 or a corresponding second limit part 133 when the handle 114 is respectively at an extended or a received position.

The seat base 1 also includes a stop wall 118 disposed at the rear end of the handle cavity 113 to stop and abut against the rear end of the handle 114 to limit insertion of the handle 114 into the handle cavity 113. The seat base 1 further includes a pair of stop parts 119 provided on the handle cavity wall 115. The handle 114 includes a pair of protruding lateral walls 1141. Each stop part 119 stops and abuts against a corresponding protruding lateral wall 1141 to limit extension of the handle 114 out of the handle cavity 113. One instead of two of the coupling parts 131, the first limit parts 132, and the second limit parts 133 may be used with similar effect to position the handle 114 either at the received position or the extended position.

As shown in FIG. 14, in this embodiment, the seat base 1 and the backrest 3 are configured to permit placement of the foldable child booster seat 100 on a support surface 4 with the handle 114 oriented upward when the backrest 3 is at the folded position. The rear end of the seat base 1 and the protruding rib 310 at the bottom end of the backrest 3 are substantially co-planar when the backrest 3 is at the folded position. Accordingly, when the backrest 3 is at the folded position, the rear end of the seat base 1 and the protruding rib 310 may be used as supports to hold the foldable child booster seat 100 on a flat support surface 4 with the handle 114 oriented upward. A user may temporarily place the foldable child booster seat 100 in this position to rest, or the user may store the foldable child booster seat 100 in this position to conserve storage space.

Figure 15:
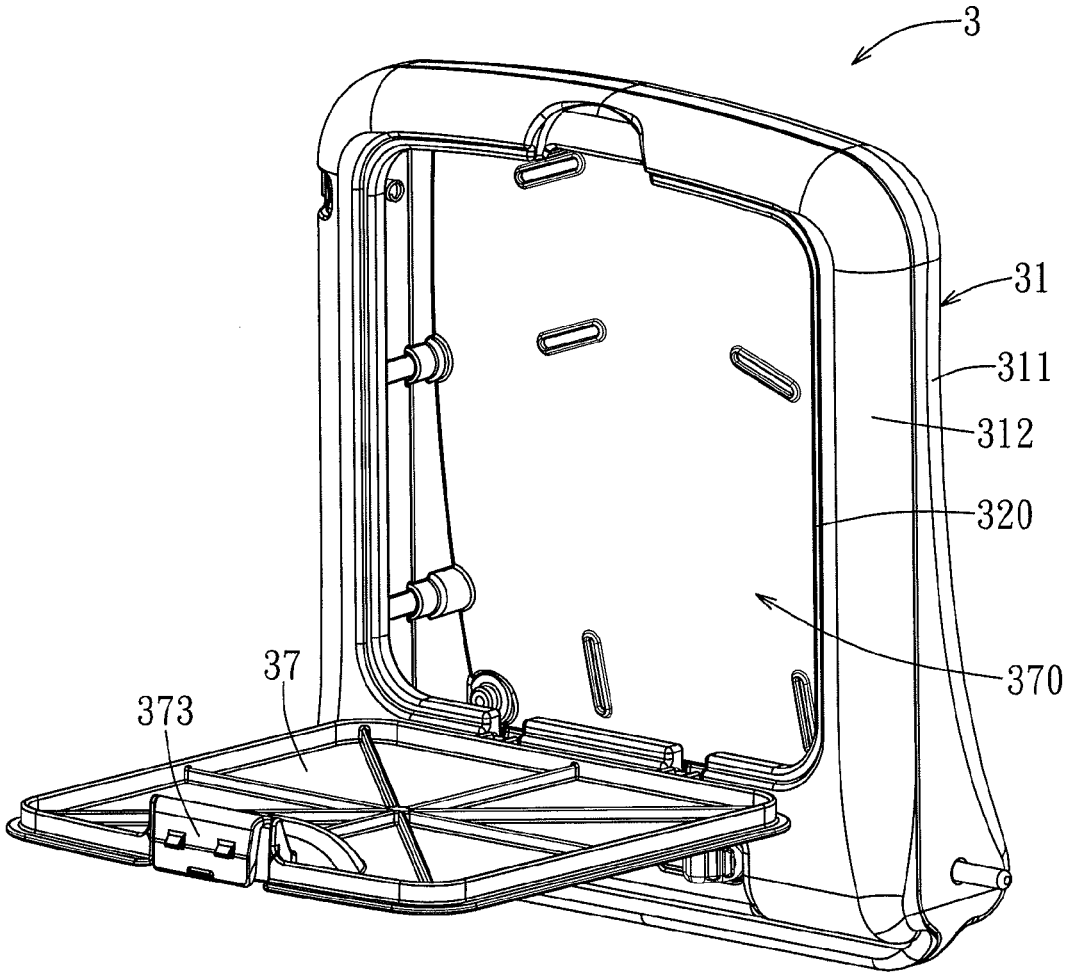
FIG. 15 is a perspective view of the backrest, illustrating a storage space, and a cover pivotably mounted to a housing of the backrest, according to the first preferred embodiment.
Figure 16:
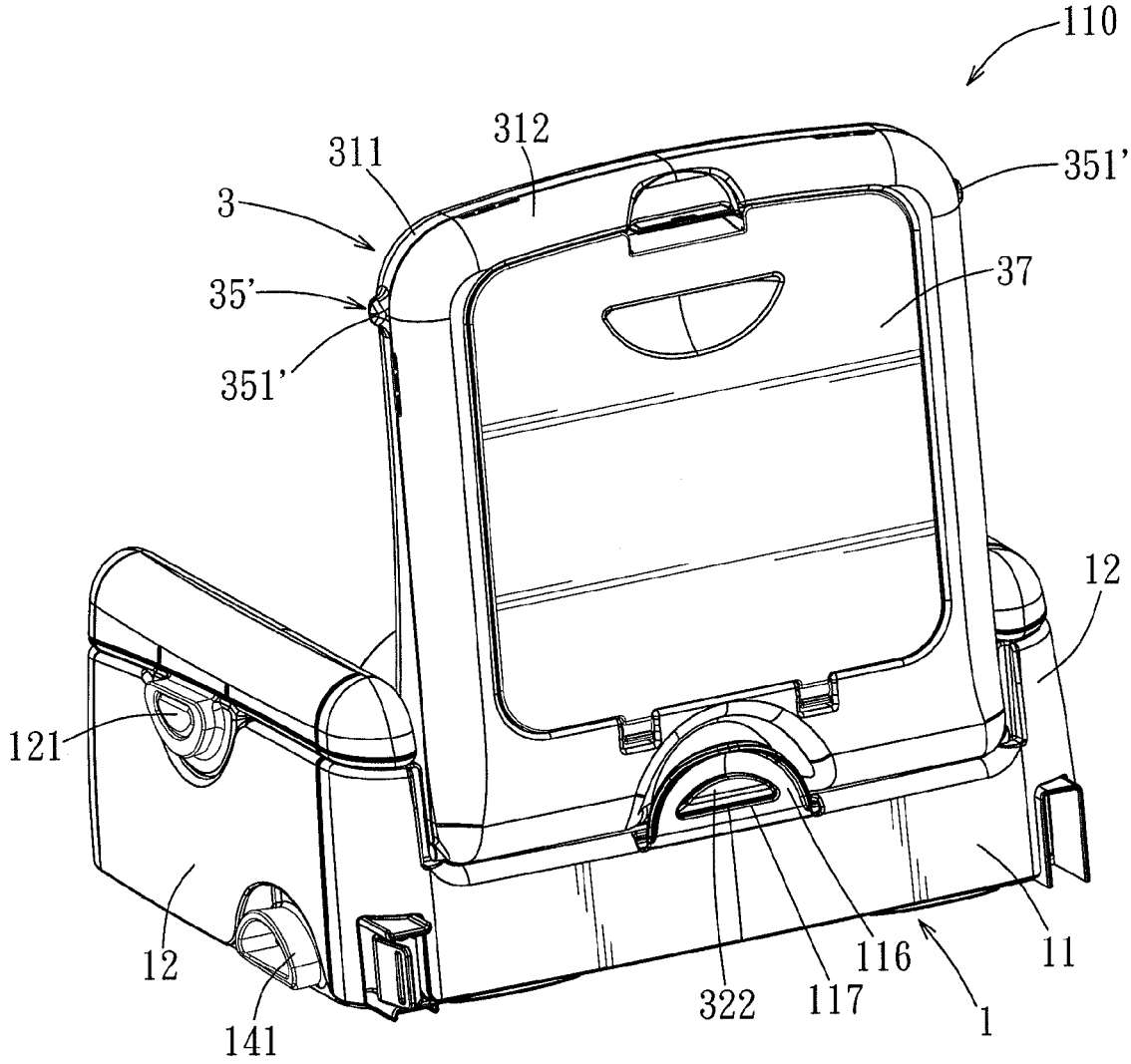
FIG. 16 is a perspective view of the foldable child booster seat without a tray, according to the second preferred embodiment of the present invention.

As shown in FIGS. 4 and 15, the rear frame 312 of the housing 31 is formed with a cavity surface 320 to provide space for accommodating objects. The cover 37 is pivotably connected to the rear frame 312 at a rear lateral side of the cavity surface 320 via engaging rings 372 provided at a bottom end of the cover 72 and pivot connection posts 321 provided on the rear frame 312. A resilient engaging piece 373 on the cover 37 removably engages the top end of the rear frame 312, which permits the cover 37 to abut against the cavity surface 320. In this way, the cover 37 cooperates with the cavity surface 320 to define a storage space 370.

A user can operate the resilient engaging piece 373 to disengage the cover 37 from the engaging position with the rear frame 312. Once disengaged, the user may rotate the cover 37 to open the storage space 370 and insert or remove objects. In other words, the housing 31 of the backrest 3 has a rear surface and is formed with a storage space 370 that opens toward the rear surface. The backrest 3 also includes a cover 37 pivoted to the housing 31 for covering and uncovering the storage space 370.

Figure 17:
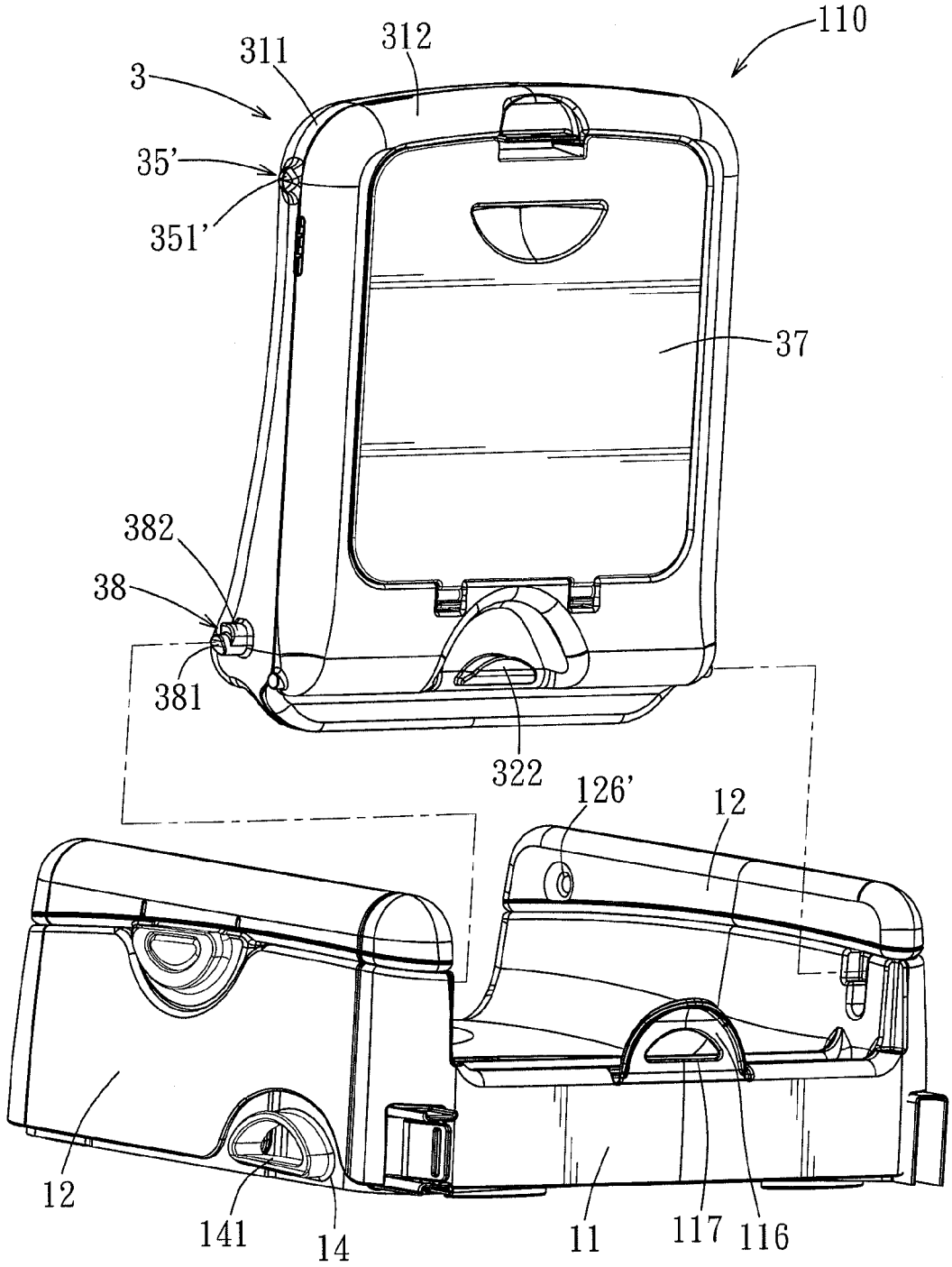
FIG. 17 is an exploded perspective view of the foldable child booster seat without the tray, according to the second preferred embodiment.
Figure 18:
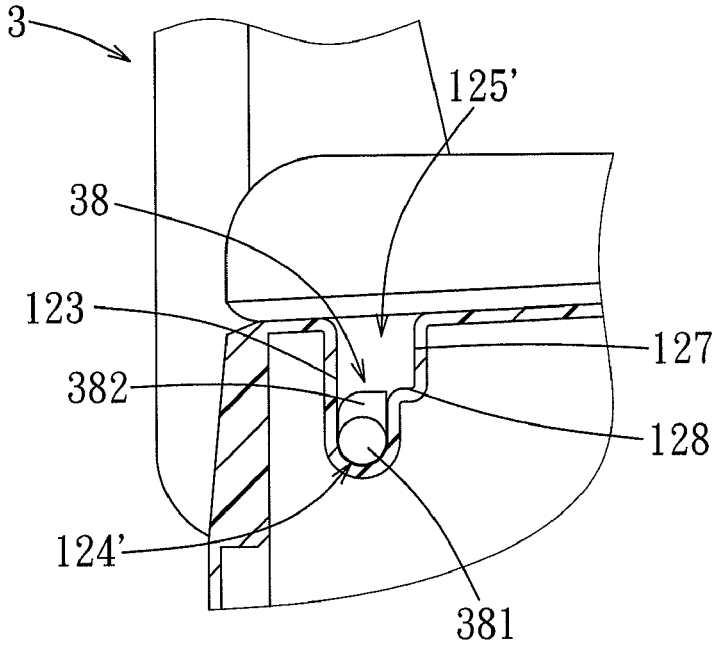
FIG. 18 is a fragmentary sectional view of a pivot portion engaged with a first positioning space when the backrest is at an unfolded state, according to the second preferred embodiment.
Figure 19:
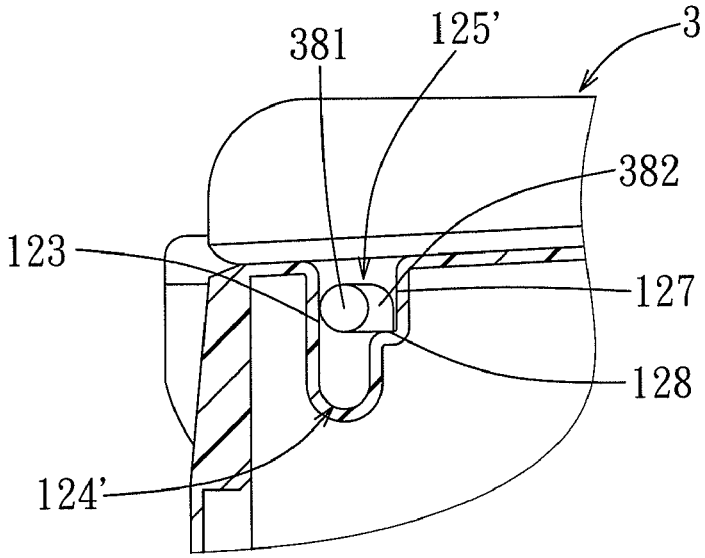
FIG. 19 is a fragmentary sectional view of the pivot portion with an eccentric protrusion abutting against a shoulder when the backrest is at a folded state, according to the second preferred embodiment.

As shown in FIGS. 16 to 19, the second preferred embodiment of the foldable child booster seat 110 of this invention differs from the first preferred embodiment primarily in the folding mechanism of the backrest 3. An inner lateral side of each armrest 12 is provided with a first engaging part 126', which is a circular hole. Each lateral side of the forward casing 311 of the backrest 3 has a latch 351', which is a circular engaging block for engaging the circular hole. Each armrest 12 includes a space-defining wall 127 bordering the second positioning space 125'. The space-defining wall 127 has a shoulder 128. Each lateral side of the forward casing 311 of the backrest 3 has a pivot piece 38 having a pivot axle 381 and an eccentric protrusion 382 provided at a top end of the outer surface of the pivot axle 381. When the backrest 3 is rotated to the folded position, the eccentric protrusion 382 abuts against the shoulder 128, as best shown in FIG. 19.

When the backrest 3 is disposed at the unfolded position, a locking protrusion 322 of the rear frame 312 of the backrest 3 engages a locking hole 117 formed in an engaging plate 116, which is disposed at a rear end of the seat portion 11. In addition, each pivot axle 381 of a corresponding pivot piece 38 engages a corresponding first positioning space 124', as best shown in FIG. 18.

In order to fold the backrest 3, the engaging plate 116 is pressed backward to disengage the locking hole 117 from the locking protrusion 322. The user can then lift the backrest 3 upward to disengage each pivot piece 38 from the corresponding first positioning space 124' and to align each pivot piece 38 with the corresponding second positioning space 125'. The backrest 3 may then be rotated to the folded position, which permits each latch 351' to engage the corresponding first engaging part 126' (as shown in FIG. 17) and permits each eccentric protrusion 382 to abut against a corresponding shoulder 128. Accordingly, the bottom and top ends of the backrest 3 are firmly supported to prevent the backrest 3 from vibrating and to prevent the bottom and top ends of the backrest 3 from drooping downward.

To sum up, in each of the two preferred embodiments of the foldable child booster seat 100, 110, when the backrest 3 is disposed at the folded position, each pivot piece 32, 38 is engaged with a corresponding second positioning space 125, 125' and each second engaging part 35, 35' is engaged with a corresponding first engaging part 126, 126'. This provides the top and bottom ends of the backrest 3 with firm support to prevent the backrest 3 from vibrating or drooping downward at either the bottom or top end of the backrest 3. In addition, when the backrest 3 is disposed at the folded position, the foldable child booster seat 100, 110 can be placed in an upright position, allowing a user to conveniently pick up or carry the foldable child booster seat 100, 110 by the handle 114. Furthermore, the design of the hollow housing 31 and the cover 37 of the backrest 3 provides an effective storage space 370 within the foldable child booster seat 100.

While the present invention has been described in connection with what are considered the most practical and preferred embodiments, it is to be understood that this invention is not limited to the disclosed embodiments but is intended to cover all modifications and equivalent arrangements included within the spirit and scope of the broadest interpretation of this document.

What is claimed is:

1. A foldable child booster seat, comprising:

a seat base that includes a seat portion having a seating surface, and a pair of armrests respectively disposed at left and right sides of said seat base;

a backrest mounted foldably to said seat base;

a support unit movably coupled to said seat base to permit height adjustment of said seat portion relative to said support unit; and a tray removably mountable to said armrest to dispose said tray in a state of use, and to said support unit to dispose said tray in a stowed state;

said foldable child booster seat being usable as a height-adjustable seat when said tray is disposed in the stowed state.

2. The foldable child booster seat as claimed in claim 1, wherein one of said armrests includes a rearward inner side formed with a vertically extending elongated guide channel, and further formed with a first positioning space and a second positioning space that are vertically spaced apart with said second positioning space disposed above said first positioning space, said backrest including a pivot piece that is movable along said elongated guide channel between said first positioning space and said second positioning space, said pivot piece being pivotable in said second positioning space to permit pivoting of said backrest between folded and unfolded positions relative to said seat base, one of said armrests further including a forward inner side provided with a first engaging part, said backrest further having an upper side provided with a second engaging part for coupling removably with said first engaging part when said backrest is at said folded position.

3. The foldable child booster seat as claimed in claim 2, wherein said first positioning space and said second positioning space are respectively disposed at opposite ends of said elongated guide channel and are in spatial communication with said elongated guide channel.

4. The foldable child booster seat as claimed in claim 3, wherein one of said first engaging part and said second engaging part is formed with a latch cavity, and the other one of said first engaging part and said second engaging part includes a latch for engaging removably said latch cavity.

5. The foldable child booster seat as claimed in claim 4, further comprising a latch spring for biasing said latch toward said latch cavity.

6. The foldable child booster seat as claimed in claim 3, wherein said one of said armrests that is formed with said elongated guide channel is further formed with a space-defining wall bordering said second positioning space, said space-defining wall having a shoulder, said pivot piece having an eccentric protrusion that abuts against said shoulder when said backrest is at said folded position.

7. The foldable child booster seat as claimed in claim 6, wherein said first positioning space and said eccentric protrusion are configured to arrest rotation of said backrest relative to said seat base when said backrest is at said unfolded position.

8. The foldable child booster seat as claimed in claim 3, wherein said seat base is formed with a handle cavity, said foldable child booster seat further comprising a handle received in said handle cavity and movable between a received position and an extended position relative to said seat base.

9. The foldable child booster seat as claimed in claim 8, further comprising a releasable coupling mechanism provided on said seat base and said handle for releasably retaining said handle at one of said received position and said extended position.

10. The foldable child booster seat as claimed in claim 9, wherein said seat base has a handle cavity wall that confines said handle cavity, said releasable coupling mechanism including a coupling part provided on said handle, and a first limit part provided on said handle cavity wall to couple releasably with said coupling part when said handle is at the extended position.

11. The foldable child booster seat as claimed in claim 10, wherein said handle cavity has an open end through which said handle is extendable, said releasable coupling mechanism further including a second limit part provided on said handle cavity wall, said first limit part and said second limit part being respectively proximate to and distal from said open end of said handle cavity, said second limit part coupling releasably with said coupling part when said handle is at said received position.

12. The foldable child booster seat as claimed in claim 8, wherein said seat base and said backrest are configured to permit placement of said foldable child booster seat on a support surface with said handle oriented upward when said backrest is at said folded position.

13. The foldable child booster seat as claimed in claim 2, wherein said pivot piece resiliently projects from a lower lateral side of said backrest and is biased toward said one of said armrests that is formed with said elongated guide channel.

14. The foldable child booster seat as claimed in claim 13, wherein said backrest is further formed with a horizontally extending slide channel, said pivot piece extending into said slide channel, said backrest further including a manually operable part for moving said pivot piece along said slide channel to disengage said pivot piece from one of said first positioning space and said second positioning space, and a pivot piece spring for biasing said pivot piece toward said one of said armrests that is formed with said elongated guide channel.

15. The foldable child booster seat as claimed in claim 14, wherein each of said first positioning space and said second positioning space has a depth that is deeper than a depth of said elongated guide channel.

16. The foldable child booster seat as claimed in claim 3, wherein said backrest includes a housing that has a rear surface and that is formed with a storage space that opens toward said rear surface, and a cover pivoted to said housing for covering and uncovering said storage space.

17. The foldable child booster seat as claimed in claim 1, wherein each of said armrests includes a rearward inner side formed with a vertically extending elongated guide channel, and further formed with a first positioning space and a second positioning space that are vertically spaced apart with said second positioning space disposed above said first positioning space, said backrest including a pair of pivot pieces each of which is movable along said elongated guide channel of a corresponding one of said armrests between said first positioning space and said second positioning space, each of said pivot pieces being pivotable in said second positioning space of the corresponding one of said armrests to permit pivoting of said backrest between folded and unfolded positions relative to said seat base, each of said armrests further including a first engaging part, said backrest further having a pair of second engaging parts for coupling removably with said first engaging parts of said armrests when said backrest is at one of said folded and unfolded positions.

18. The foldable child booster seat as claimed in claim 17, wherein said backrest is further formed with a horizontally extending slide channel, said pivot pieces extending into said slide channel, said backrest further including a pair of manually operable parts, each of which is operable to move a corresponding one of said pivot pieces along said slide channel to disengage the corresponding one of said pivot pieces from one of said first positioning space and said second positioning space of a corresponding one of said armrests, and a pair of pivot piece springs each biasing a corresponding one of said pivot piece toward the corresponding one of said armrests.

19. The foldable child booster seat as claimed in claim 1, wherein said seat base is formed with a locking hole, said backrest being formed with a locking protrusion that is engageable removably with said locking hole when said backrest is at said unfolded position.

* * * * *